US008926170B2

(12) United States Patent
Helfer et al.

(10) Patent No.: US 8,926,170 B2
(45) Date of Patent: Jan. 6, 2015

(54) TIMEPIECE ANTI-SHOCK SYSTEM

(75) Inventors: Jean-Luc Helfer, Bienne (CH); Yves Winkler, Schmitten (CH); Michel Willemin, Preles (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 13/806,405

(22) PCT Filed: Jun. 22, 2011

(86) PCT No.: PCT/EP2011/060405

§ 371 (c)(1),
(2), (4) Date: Apr. 8, 2013

(87) PCT Pub. No.: WO2011/161139

PCT Pub. Date: Dec. 29, 2011

(65) Prior Publication Data

US 2013/0188462 A1 Jul. 25, 2013

(30) Foreign Application Priority Data

Jun. 22, 2010 (CH) ..... 1017/10

(51) Int. Cl.
*G04B 29/00* (2006.01)
*G04B 31/02* (2006.01)
*G04B 31/04* (2006.01)

(52) U.S. Cl.
CPC ..... *G04B 31/02* (2013.01); *G04B 31/04* (2013.01)
USPC ..... 368/326; 368/287

(58) Field of Classification Search
USPC ..... 368/324–326, 286–288
See application file for complete search history.

(56) References Cited

U.S. PATENT DOCUMENTS

| | | | | |
|---|---|---|---|---|
| 6,843,594 | B1 * | 1/2005 | Moteki et al. | 368/140 |
| 7,234,859 | B2 * | 6/2007 | Kohler et al. | 368/326 |
| 7,344,303 | B2 * | 3/2008 | Conus et al. | 368/324 |
| 8,348,496 | B2 * | 1/2013 | Gritti et al. | 368/140 |
| 2007/0034304 | A1 | 2/2007 | Inoue et al. | |
| 2007/0133355 | A1 * | 6/2007 | Hara et al. | 368/140 |
| 2009/0194205 | A1 | 8/2009 | Loffler et al. | |
| 2011/0164478 | A1 | 7/2011 | Conus et al. | |
| 2013/0148480 | A1 * | 6/2013 | Charbon et al. | 368/132 |

FOREIGN PATENT DOCUMENTS

| | | |
|---|---|---|
| CH | 199012 | 7/1938 |
| CH | 235315 | 11/1944 |
| EP | 1 696 153 | 8/2006 |
| EP | 2 015 147 | 1/2009 |
| EP | 2 142 965 | 1/2010 |
| WO | 2007 038882 | 4/2007 |

OTHER PUBLICATIONS

International Search Report Issued Nov. 28, 2011 in PCT/EP11/60405 Filed Jun. 22, 2011.

* cited by examiner

*Primary Examiner* — Sean Kayes
(74) *Attorney, Agent, or Firm* — Oblon, Spivak, McClelland, Maier & Neustadt, L.L.P.

(57) ABSTRACT

A shock absorber bearing for an arbor of a timepiece wheel set. The arbor includes a pivot-shank extended by a pivot. The bearing includes a support including a recess for receiving a pivot system into which the pivot-shank is inserted. The pivot system is arranged to absorb, at least in part, shocks experienced by the timepiece wheel set and is formed of a single piece made of an at least partially amorphous metal alloy.

4 Claims, 3 Drawing Sheets

TIMEPIECE ANTI-SHOCK SYSTEM

CROSS-REFERENCE TO RELATED APPLICATIONS

This is a National Phase Application in the United States of International Patent Application PCT/EP2011/060405 filed Jun. 22, 2011, which claims priority on Swiss Patent Application No. 01017/10 of Jun. 22, 2010. The entire disclosures of the above patent applications are hereby incorporated by reference.

The present invention concerns a shock absorber bearing for an arbour of a timepiece wheel set. The arbour includes a pivot-shank extended by a pivot and the bearing includes a support, said support being provided with a recess for receiving a suspended pivot system into which the pivot-shank is inserted.

The technical field of the invention is the technical field of fine mechanics.

BACKGROUND OF THE INVENTION

The present invention concerns bearings for timepieces and more specifically of the shock absorber type. Designers of mechanical watches have for a long time devised numerous devices for absorbing the energy resulting from a shock, particularly a lateral shock, by the abutment of the arbour against a wall of the hole in the base block through which the arbour passes, while allowing a temporary movement of the pivot-shank before it is returned to its rest position under the action of a spring.

FIGS. 1 and 2 illustrate a device, called a double inverted cone device, which is currently used in timepieces found on the market.

A support 1, the base of which comprises a hole 2 for the balance staff 3 ending in pivot-shank 3*a*, allows a setting 20 to be positioned, in which a pierced stone 4, traversed by pivot-shank 3*a*, and an endstone 5 are fixedly secured. Setting 20 is held in a recess 6 of support 1 by a spring 10 which, in this example, includes radial extensions 9 compressing endstone 5. Recess 6 includes two shoulders 7, 7*a* in the form of inverted cones on which complementary shoulders 8, 8*a* of setting 20 rest. Said shoulders must be made with a high level of precision. In the event of an axial shock, pierced jewel 4, endstone 5 and the balance staff move and spring 10 acts alone to return balance staff 3 to its initial position. Spring 10 is sized to have a maximum limit of movement so that, beyond the maximum limit, the balance staff comes into contact with stop members allowing said staff to absorb the shock, which the pivot-shanks of the staff cannot do without breaking. In the event of a lateral shock, i.e. when the end of the pivot-shank unbalances setting 20 out of its lest plane, spring 10 cooperates with the complementary inclined planes 7, 7*a*; 8, 8*a* to recentre setting 20. These bearings have been sold for example under the trademark Incabloc®. These springs may be made of phynox or brass and are manufactured by conventional cutting means.

Shock absorber bearings in which the spring, the pierced jewel and the endstone form a unit are also known. The advantage of these shock absorber bearings is that they are less expensive.

Thus, U.S. Pat. No. 3,942,848 discloses a shock absorber bearing comprising an annular body intended to be driven into a bridge or plate. A spring, shaped to form a conical recess, is secured to the body. This recess forms a cup bearing inside which a conical balance pivot is engaged. In this design, the pivoting conditions are not very favourable, since the pivoting of metal on metal causes significant friction. Further, a cup bearing according to U.S. Pat. No. 3,942,848 cooperating with a conical pivot is ill-suited for use in a high quality timepiece, since the positioning of the balance is not precise.

Moreover, the springs used in these shock absorber bearings are made of crystalline metal. The use of crystalline metals for these springs may cause certain problems. Indeed, crystalline metals are characterized by weak mechanical properties such as limited elastic deformation which can lead to plastic deformation if the shocks are too great. This is exacerbated by the fact that the springs currently used cannot be devised with complex shapes and, consequently, the elastic deformation of current springs is very close to the limit of elasticity.

Thus, if too great a shock is applied to the timepiece, the movement of the jewels and the balance may be of large amplitude and consequently plastic i.e. permanent deformation of the spring may occur. The spring becomes less efficient at absorbing shocks and re-centring the balance staff in its rest position since it no longer returns to its original shape and therefore loses elasticity.

This permanent deformation may also occur when said springs are handled and set in place, when they are removed for lubrication or during finishing or after sales operations.

Shock absorber bearings in which the spring, the pierced jewel and the endstone form a unit are also known. The advantage of these shock absorber bearings is that they are less expensive.

Thus, U.S. Pat. No. 3,942,848 discloses a shock absorber bearing comprising an annular body intended to be driven into a bridge or plate. A spring, shaped to form a conical recess, is secured to the body. This recess forms a cup bearing inside which a conical balance pivot is engaged. In this design, the pivoting conditions are not very favourable, since the pivoting of metal on metal causes significant friction. Further, a cup bearing according to U.S. Pat. No. 3,942,848 cooperating with a conical pivot is ill-suited for use in a high quality timepiece, since the positioning of the balance is not precise.

Moreover, the fact of using a spring shaped to form a conical recess has the drawback of having a radial play which depends on the axial play or movement. Indeed, the conical shape of the spring allows the wheel arbour to be held properly in normal conditions. However, when the springs are deformed, the spring moves axially and radially. When the spring moves axially, the conical shape of the spring involves the presence of a radial movement as well. It is then noted that the greater the axial movement the greater the radial movement will be.

SUMMARY OF THE INVENTION

It is an object of the invention to overcome the drawbacks of the prior art by proposing to provide a timepiece anti-shock system with improved resistance to shocks and which allows improved positioning of the arbour of the damped wheel.

The invention therefore concerns the aforecited timepiece anti-shock system, which is characterized in that said pivot system is arranged to absorb, at least partly, the shocks experienced by the timepiece wheel set and in that the pivot system is formed of a single piece made of an at least partially amorphous metal alloy.

A first advantage of the present invention is that it allows anti-shock systems to withstand shocks better. Indeed, amorphous metals have more advantageous elastic characteristics. The limit of elasticity $\sigma_e$ is increased, which increases the ratio $\sigma_e/E$ so that the stress beyond which the material does not return to its initial shape increases. The pivot system can then undergo greater stress before being plastically deformed and the part can therefore withstand greater shocks without reducing the efficiency of the anti-shock system.

Another advantage of the present invention is that it enables pivot systems to be made. Indeed, because amorphous metal is capable of withstanding higher stress before deforming plastically, it is possible to make springs having smaller dimensions without losing resistance.

Advantageous embodiments of pivot systems form the subject of the dependent claims.

In a first advantageous embodiment, said pivot system is made of totally amorphous material.

In a second advantageous embodiment, said metal alloy includes at least one precious metal element or an alloy thereof.

In a third advantageous embodiment said precious metal element includes gold, platinum, palladium, rhenium, ruthenium, rhodium, silver, iridium or osmium.

In another advantageous embodiment, said pivot system is a disc including an annular portion, a central portion and elastic arms connecting the central portion to the annular portion, the central portion including a recess so that the pivot engaged therein can pivot freely therein.

In another advantageous embodiment, the recess consists of a cylindrical portion with a convex rounded portion at the end thereof.

One of the advantages of these embodiments is that they allow pivot systems having more complex shapes to be made. Indeed, amorphous metal is very easy to shape and allows the manufacture of complex shaped parts with greater precision. This is due to the particular characteristics of amorphous metal, which can soften while remaining amorphous for a certain period of time within a given temperature range [$T_g$-$T_x$] peculiar to each alloy. Thus, it is possible to shape amorphous metal under relatively low stress and at a low temperature, thereby permitting the use of a simplified method such as hot forming, while very precisely reproducing fine geometries, since the viscosity of the alloy decreases sharply with temperature within said temperature range [$T_g$-$T_x$]. Consequently, it becomes possible to make complex, precise pivot systems in a simple manner.

BRIEF DESCRIPTION OF THE DRAWINGS

The objects, advantages and features of the anti-shock system according to the present invention will appear more clearly in the following detailed description of at least one embodiment of the invention, given solely by way of non-limiting example and illustrated by the annexed drawings, in which.

DETAILED DESCRIPTION OF THE INVENTION

The present invention proceeds from the general inventive idea which consists in providing a shock absorber system having improved reliability and proposing improved positioning using an at least partially amorphous metal alloy.

Figure 1:
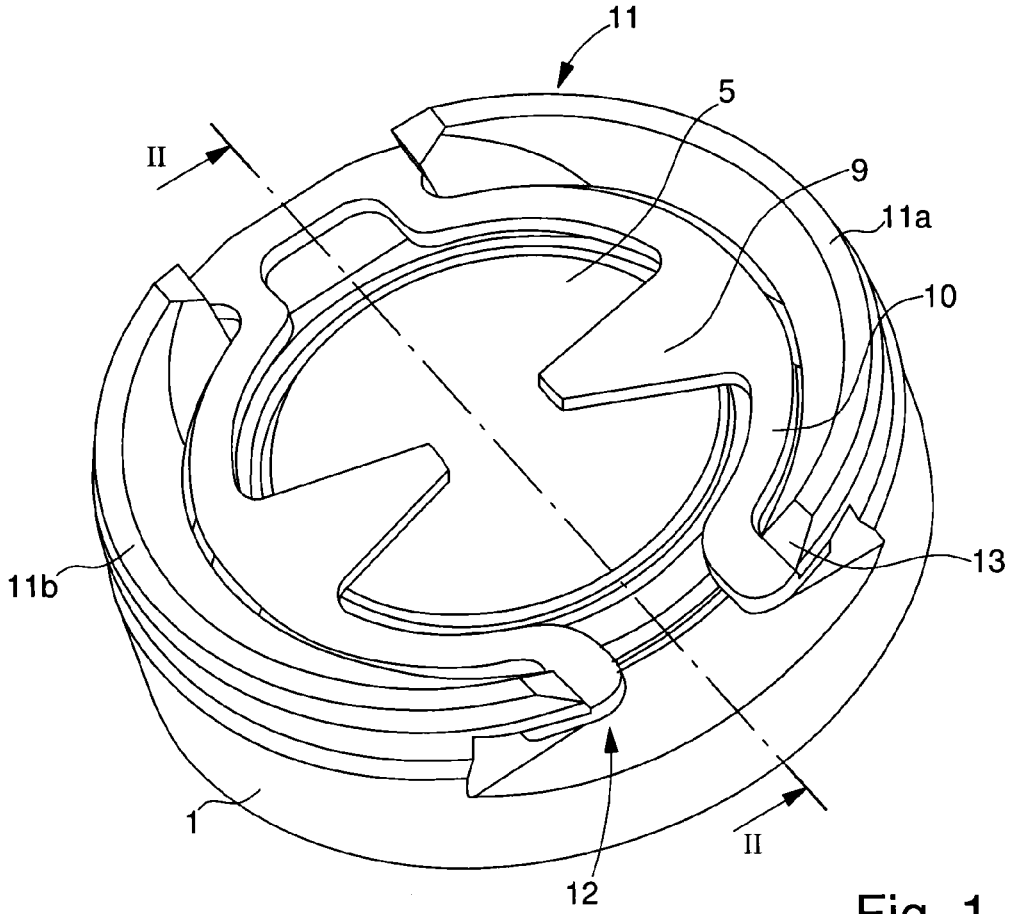
FIGS. 1 and 2 are schematic views of a timepiece anti-shock system according to the prior art.
Figure 2:
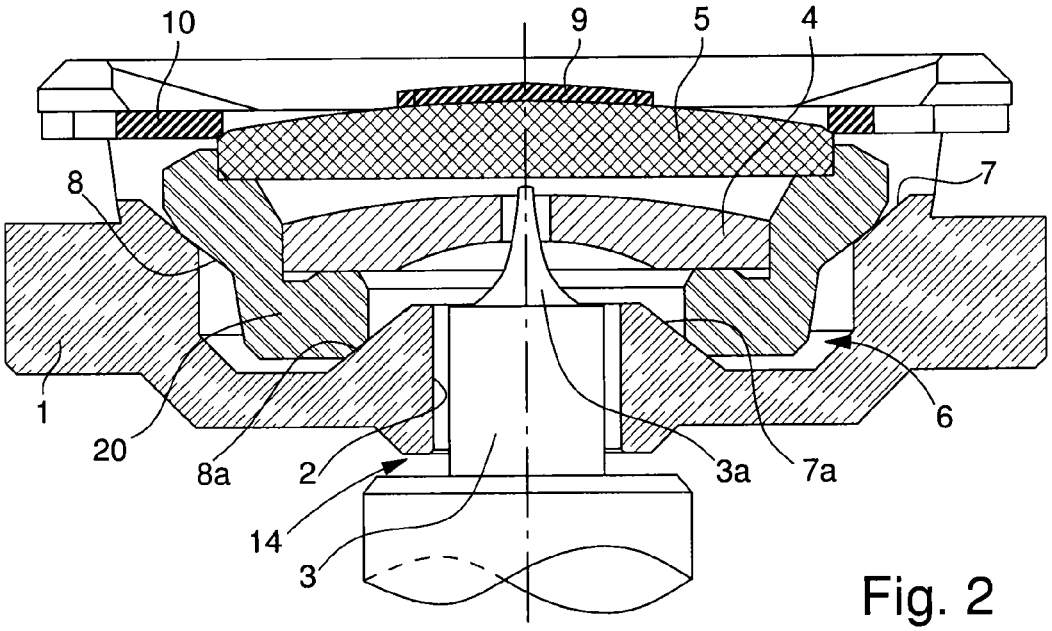
Figure 3:
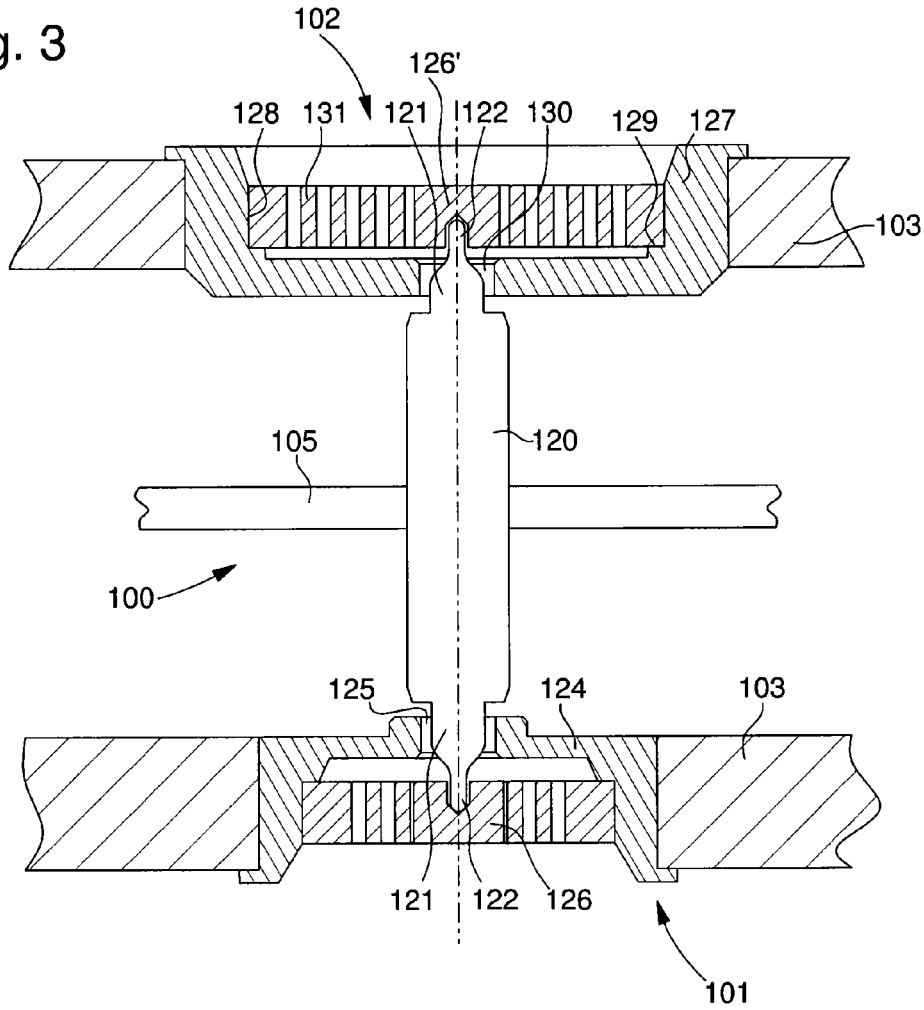
FIGS. 3 to 5 are schematic views of a timepiece anti-shock system according to the invention.

The shock absorber 101, 102 is shown in FIG. 3, which illustrates one part 100 of a timepiece provided with bearings according to the invention.

The timepiece shown in FIG. 3 includes a frame comprising a support 103, in which a bottom bearing 101 and a top bearing 102 are mounted. These bearings 101, 102 are mounted in holes made in said support 103. A wheel 105, which may for example be a balance, is pivotally mounted in the bearings. This wheel 105 includes an arbour 120 provided at both ends with pivot-shanks 121 carrying pivots 122.

Top bearing 102 includes an annular portion 127 taking the form of a disc with a peripheral wall 128. This annular portion also includes a rim 129 located on the surface of the disc and contiguous with the wall. Annular portion 127 is pierced with a central hole 130. Bearing 102 further includes a pivoting means 126' arranged in the recess formed by the peripheral wall 128 and rim 129. Pivoting means 126' is placed on the periphery of rim 129 so as to be suspended. This pivoting means 126' may for example be forcibly engaged or bonded to annular portion 127.

Bottom bearing 101 is of identical design to top bearing 102, i.e. it includes an annular portion 124 taking the form of a disc with a peripheral wall. This annular portion also includes a rim located on the surface of the disc and contiguous with the wall. Annular portion 124 is pierced with a central hole 125. Bearing 102 further includes a means of pivoting 126 arranged in the recess formed by the peripheral wall and the rim. This pivoting means 126 may be for example forcibly engaged or bonded to annular portion 124. In this example, the dimensions of the bottom bearing 101 will be smaller than those of top bearing 102 so as to demonstrate that the size of the bearing can easily be modulated and can be adapted to requirements, by reducing its size here for example. Of course, the dimensions of the top bearing 102 and bottom bearing 101 may be identical.

However, bottom bearing 101 or top bearing 102 may be arranged so that the pivoting means 126, 126' is driven directly into support 103. Said bearing 101, 102 further includes a part 200, taking the form of a ring, which is used to hold pivoting means 126, 126' and a part 201, taking the form of a disc with a peripheral rim 202 and pierced at the centre thereof with a hole 125, 130. This pierced disc part 201 is used to serve as a stop member and the rim 202 thereof is used to provide a suspended system. Pivoting means 126, 126' is thus held radially by the walls of the hole made in support 103 and axially by annular portion 200 and the pierced disc part 201.

Figure 4:
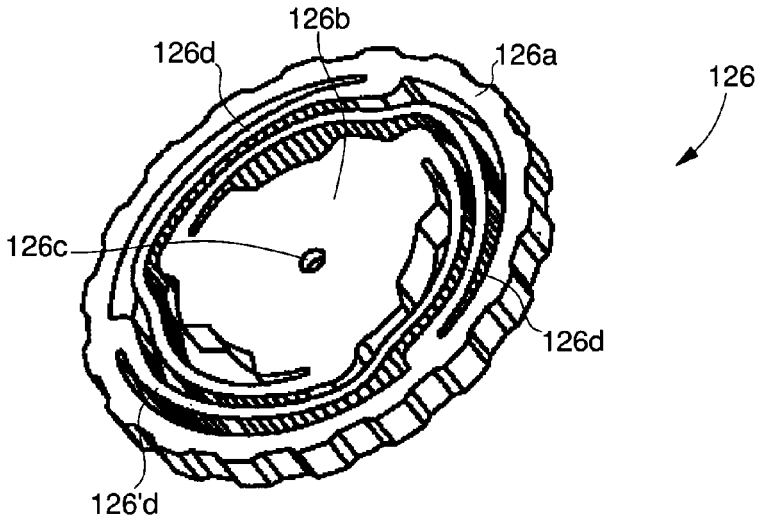
Figure 5:
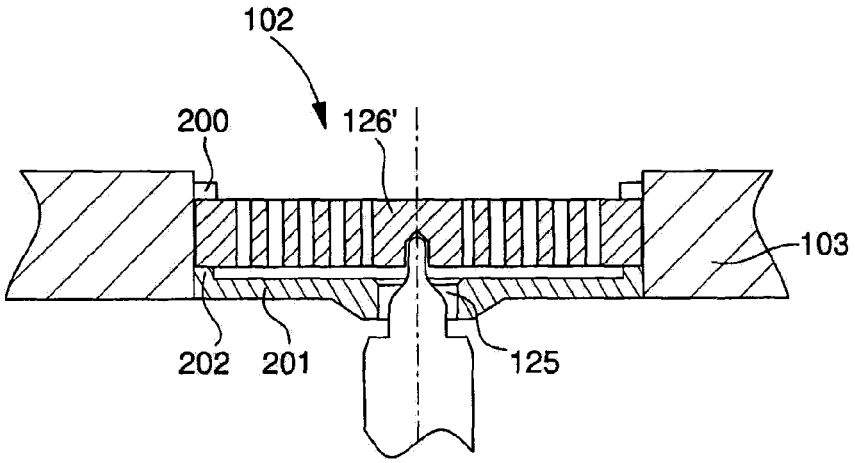

The pivoting means 126, 126', visible in FIG. 4, take the form of discs comprising a full annular portion **126*a*, a central portion 126*b* provided with a cylindrical blind recess 126*c* and elastic arms 126*d*. The diameter of blind cylindrical recess 126*c* is selected such that the pivot 122 which is engaged therein can pivot freely therein with a minimum clearance. Arms 126*d* are wound in a spiral to that they connect central portion 126*b* to annular portion 126*a*. Preferably, pivoting means 126, 126' have three arms. Pivoting means 126' of top bearing 102 is mounted in annular portion 127 of said top bearing 102. Pivoting means 126 of bottom bearing 103 is mounted in annular portion 124 of said bottom bearing 103. The two annular portions 127, 124 are then mounted in the hole in support 103** in sequence to allow the wheel to be inserted on its arbour.

The wheel is thus pivotally mounted by the engagement of the pivots 122 thereof in blind cylindrical recesses **126*c* of pivoting means 126, 126' and of the pivot-shanks 121 thereof in the areas provided in support 103**.

In the event of a shock, wheel 105 is subjected to a force which is proportional to the acceleration experienced. This force is transmitted to the bearings via pivots 122. The effect of this force is to deform elastic arms **126*d* of pivoting means 126, 126' until the arbour of the wheel rests, via the pivot shanks 121 thereof, against the wall of the holes in annular portions 127, 124. The wheel is then stopped and locked by a portion of its arbour which has much larger dimensions than that of pivots 122, thus avoiding damaging pivot shanks 121**. Since this portion has much larger dimensions than those of the pivots, it is capable of withstanding much greater stresses without any detrimental consequences for the wheel set.

Preferably, the elastic arms are sized so that pivot-shanks 121 enter into contact with the annular portions when the acceleration reaches around 500 g.

Preferably, pivoting means 126, 126' are formed by three bent arms 126*d*, whose points of attachment, respectively to annular portion 126*a* and to central portion 126*b*, are angularly shifted by 120 degrees. It is clear that the elastic function could be ensured with a different number of arms, or with other shapes.

It is also possible for the pivoting means 126, 126' to include a conical recess so that the end of the pivot shank can be inserted therein, thus reducing the difference in amplitude between the different positions of the watch to a minimum. This conical recess, known from EP Patent No. 2,142,965 consists in a trapezoidal or cylindrical portion with a rounded convex portion at the end thereof.

Advantageously, pivoting means 126, 126' are made of an amorphous or at least partially amorphous metal. In particular, a material including at least one metal element is used. Preferably, the material will be an at least partially amorphous or totally amorphous metal alloy. An "at least partially amorphous material" means that the material is capable of at least partially solidifying in amorphous phase, i.e. it is capable of at least partially losing any local crystalline structure.

Indeed, the advantage of these amorphous metal alloys arises from the fact that, during manufacture, the atoms forming the amorphous materials do not arrange themselves in a particular structure as is the case of crystalline materials. Thus, even if the Young's modulus E of a crystalline metal and that of an amorphous metal are identical, the limit of elasticity $\sigma_e$ is different. An amorphous metal differs therefore in that it has a higher limit of elasticity $\sigma_e$ than that of the crystalline metal by a factor of around two to three. This means that amorphous metals can withstand higher stress before reaching the limit of elasticity $\sigma_e$.

These pivoting means 126, 126' have the advantage of having greater resistance and longevity compared to their crystalline metal equivalents.

Further, since the limit of elasticity of an amorphous metal is higher than that of a crystalline metal by a factor of around two to three, allowing said metal to resist higher stresses, it is possible to envisage reducing the dimensions of said pivoting means 126, 126'. Indeed, since the anti-shock system pivoting means made of amorphous metal can withstand a greater stress without deforming plastically, it is then possible, with the same stress, to reduce the dimensions of pivoting means 126, 126' compared to a crystalline metal.

Several methods may be envisaged to make these pivoting means 126, 126'. It is possible to envisage making pivoting means 126, 126' by using the properties of amorphous metals. Indeed amorphous metal is very easy to shape, allowing parts with complicated shapes to be made simply and with greater precision. This is due to the particular characteristics of amorphous metal which can soften while remaining amorphous for a certain period of time within a given temperature range $[T_g\text{-}T_x]$ peculiar to each alloy, for example for a $Zr_{41.24}Ti_{13.77}Cu_{12.7}Ni_{10}Be_{22.7}$ alloy $T_g$=350° C. and $T_x$=460° C.) It is therefore possible to shape these metals under relatively low stress and at a low temperature thus allowing a simplified process such as hot forming to be used. The use of this type of material also allows the very precise reproduction of fine geometries, since the viscosity of the alloy decreases sharply according to temperature within the temperature range $[T_g\text{-}T_x]$ and the alloy thus adopts all the details of the negative form. For example, for a platinum-based material, shaping occurs at around 300° C. for a viscosity of up to $10^3$ Pa·s for a stress of 1 MPa, instead of a viscosity of $10^{12}$ Pa·s at temperature Tg.

The method used is the hot forming of an amorphous preform. This preform is obtained by melting the metal elements forming the amorphous alloy in a furnace. The melting is carried out in a controlled atmosphere in order to obtain the lowest possible oxygen contamination of the alloy. Once these elements have melted, they are cast in the shape of semi-finished products, and then rapidly cooled to preserve the at least partially amorphous state or phase. Once the preform has been obtained, the hot forming is carried out in order to obtain a finished part. This hot forming is achieved by pressing within a temperature range comprised between the vitreous transition temperature $T_g$ of the amorphous material and the crystallisation temperature $T_x$ of said amorphous material for a determined period of time in order to preserve a totally or partially amorphous structure. The object is to preserve the characteristic elastic properties of the amorphous metals. The various final shaping steps of the pivoting means are thus:

a) Heating the dies of the mould having the negative shape of pivoting means 126, 126' to a selected temperature.
b) Inserting the amorphous metal preform between the hot dies.
c) Applying a closing force onto the dies to replicate the geometry of said dies on the amorphous metal preform.
d) Waiting for a selected maximum time.
e) Rapidly cooling the spring below $T_g$ so that the material keeps its at least partially amorphous phase.
f) Opening the dies.
g) Removing pivoting means 126, 126' from the dies.

Hot forming the amorphous metal or alloy can therefore not only produce complex precise parts but also achieves good reproducibility of the part, which is a significant advantage for the mass production for example of pivoting means 126, 126' of damping systems.

According to an alternative of this method, casting is used. This method consists in casting the alloy obtained by melting the metallic elements in a mould having the shape of the final part. Once the mould has been filled, it is rapidly cooled to a temperature below $T_g$ to prevent the alloy crystallising and thus to obtain amorphous or partially amorphous metal pivoting means. The advantage of casting an amorphous metal compared to casting a crystalline metal is that it is more precise. The solidification shrinkage is very low for an amorphous metal, less than 1% compared to that of crystalline metals, which is from 5 to 7%.

The methods used for amorphous metal thus allow precise parts to be produced, which is advantageous for making pivoting means with smaller dimensions. This precision is combined with a very high level of reproducibility of the method making it easy to mass produce parts.

It will be clear that various alterations and/or improvements and/or combinations evident to those skilled in the art may be made to the various embodiments of the invention set out above without departing from the scope of the invention defined by the annexed claims.

The invention claimed is:

1. A shock absorber bearing for an arbour of a timepiece wheel set, said arbour comprising a pivot-shank extended by a pivot;

said bearing comprising a support including a recess for receiving a suspended pivot system into which the pivot-shank is inserted;

wherein said pivot system is arranged to absorb, at least in part, shocks experienced by the timepiece wheel set, and the pivot system is formed of a single piece made of totally amorphous metal alloy; and wherein said pivot system is a disc including an annular portion, a central portion, and elastic arms connecting the central portion to the annular portion, the central portion comprising a recess so that the pivot which is engaged therein can pivot freely therein.

2. The shock absorber bearing according to claim 1, wherein said metal alloy includes at least one precious metal element or an alloy thereof.

3. The shock absorber bearing according to claim 2, wherein said precious metal alloy includes gold, platinum, palladium, rhenium, ruthenium, rhodium, silver, iridium or osmium.

4. The shock absorber bearing according to claim 1, wherein the recess includes a cylindrical portion including a rounded convex portion at an end thereof.

* * * * *